United States Patent [19]

Galloway

[11] Patent Number: 4,953,332

[45] Date of Patent: Sep. 4, 1990

[54] MASONRY STRUCTURE SYSTEM

[76] Inventor: Craig D. Galloway, 3509 West 5175 South, Roy, Utah 84067

[21] Appl. No.: 352,026

[22] Filed: May 15, 1989

[51] Int. Cl.[5] ..... E04C 3/10

[52] U.S. Cl. ..... 52/228; 52/396

[58] Field of Search ..... 52/227, 228, 396, 307, 52/308, 229

[56] References Cited

U.S. PATENT DOCUMENTS

| | | | |
|---|---|---|---|
| 2,032,852 | 3/1936 | Powell | 52/396 |
| 2,114,906 | 4/1938 | Nyhagen, Jr. | 52/396 |
| 2,193,380 | 3/1940 | Price | 52/396 X |
| 2,244,489 | 6/1941 | Downes | 52/228 X |
| 3,234,699 | 2/1966 | Smith | 52/396 X |
| 3,256,657 | 6/1966 | Phipps | 52/396 X |
| 3,378,969 | 4/1968 | Larger | 52/228 |
| 3,962,088 | 6/1976 | Kuhlenschmidt et al. | 52/227 X |
| 4,324,037 | 4/1982 | Grady, II | 52/227 X |
| 4,428,174 | 1/1984 | Grady, II | 52/227 X |
| 4,757,656 | 7/1988 | Powers, Jr. | 52/228 X |

*Primary Examiner*—Carl D. Friedman

*Attorney, Agent, or Firm*—A. Ray Osburn

[57] ABSTRACT

A masonry structure system providing a stable, structurally sound combination of conventional building units such as bricks and concrete blocks without the use of mortar. Assemblage of the standard building units are held together by tension members. The masonry units may bear directly upon each other, or the system may employ an interface layer of pressed wood, plastic, or other readily available material.

7 Claims, 3 Drawing Sheets

MASONRY STRUCTURE SYSTEM

BACKGROUND OF THE INVENTION

1. Field: The field of the invention is apparatus and methods for utilization of conventional building units to form structures thereof.

2. State of the Art: Since the invention of hard-setting mortar centuries, even millenia ago, it has been the mainstay for securing masonry building units together within edifices, walls, bridges, and other structures. Mortar is utilized for native field stone, cut stone, baked clay bricks and cast concrete blocks. Traditionally, the conventional cut or cast building units have been right-angled, plane sided blocks. In recent decades, however, many have proposed the use of building units cast into interlocking shapes to be utilized in some structures without the use of mortar. Examples include U.S. Pat. Nos. 3,618,279, 990, 119, French Patent No. 915,121, and U.S. Pat. No. 2,991,818. Some prior art building systems utilize some sort of bearing member between mating block faces. In U.S. Pat. No. 4,901,587, an elaborately shaped interface member is used with standard concrete blocks. For stability, reinforcing rods are grouted in place vertically through holes cast in the cement blocks. Thus, the system does not escape the use of cementitious material to provide structural integrity. U.S. Pat. No. 3,382,632 discloses a system using blocks especially cast into interlocking shapes with vertically oriented J-bolts used as tension members between stacked layers of the blocks. Clearly, all of the prior art building block systems are undesirably complex and expensive, require cementitious bonding, or fail to utilize conventional masonry units.

BRIEF SUMMARY OF THE INVENTION

With the foregoing in mind, the present invention eliminates or substantially alleviates the shortcomings in prior art masonry building systems by providing a system which permits standard fired clay or cast concrete building units to be secured together into a structure without the use of mortar or any other masonry adherent material. The building units are secured into the desired structural combinations by adjustable tension bars placed vertically, for example, to press stacked horizontal rows of bricks or concrete blocks firmly together. Each building unit is gripped by contacting sides preventing its dislodgement. Preferably, the system also includes flat members of nonadherent compressible, preferably resilient material interposed between the building units. These interface members substantially eliminate bending and shearing forces in the individual building units, forces which in conventional mortar construction result from cure shrinkage of the mortar, seasonal temperature variations, and foundation settling and upheaval. Often, mortar or the building units themselves are chipped or fractured by these forces. Non-destructive disassembly of the structure for recovery and reuse of the building units for other structures in other configurations is readily achieved.

It is therefore the principal object of the invention to provide an improved masonry building system utilizing conventional building units without the use of mortar.

BRIEF DESCRIPTION OF THE DRAWINGS

In the drawings, which represent the best mode presently contemplated for carrying out the invention.

DETAILED DESCRIPTION OF ILLUSTRATED EMBODIMENTS

Figure 1:
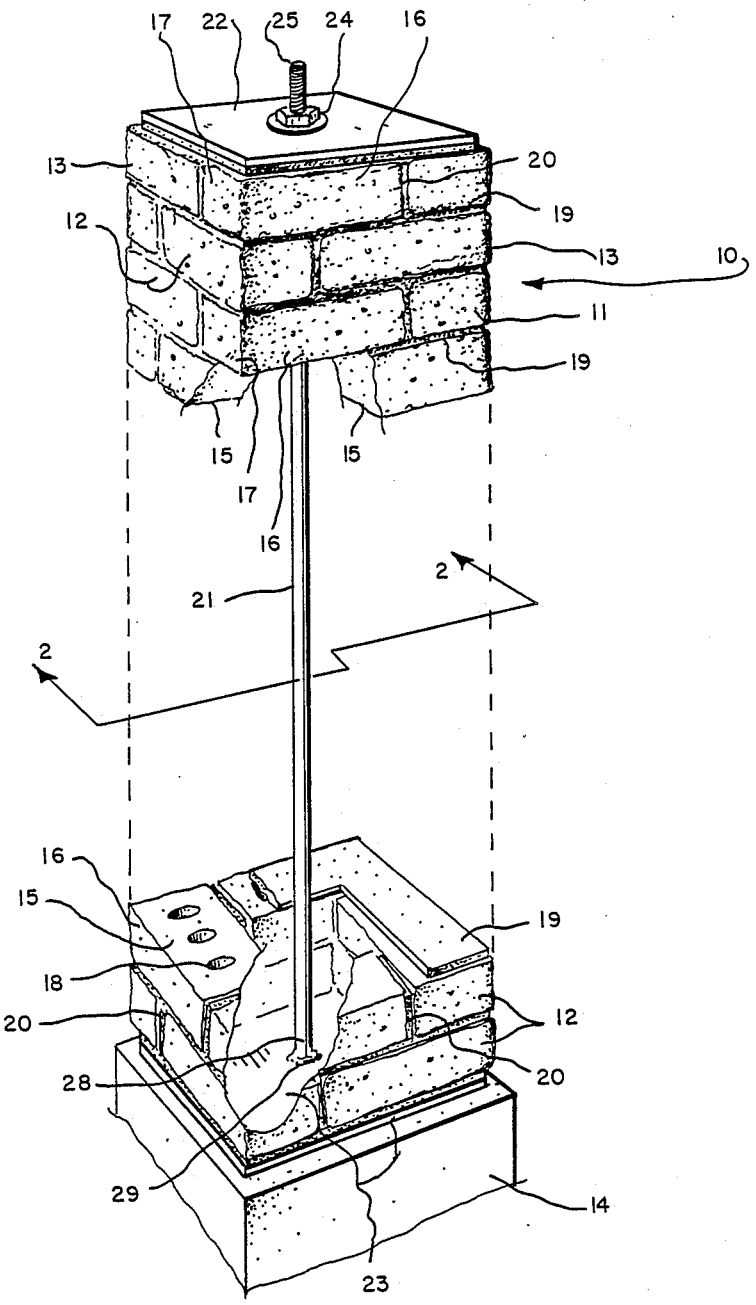
FIG. 1 is a perspective view of a decorative gate post utilizing the inventive masonry structure system, fragmentally shown, drawn to a reduced scale, FIG. 2 a vertical sectional view of the structure of FIG. 1 taken along line 2—2 thereof, drawn to the same scale, FIG. 3 an elevation view of a fragment of a wall and corner of concrete blocks utilizing the inventive masonry structure system, partially cut away, drawn to a reduced scale, and FIG. 4 a top view of the fragment of FIG. 3, taken along line 4—4 thereof, drawn to the same scale.
Figure 2:
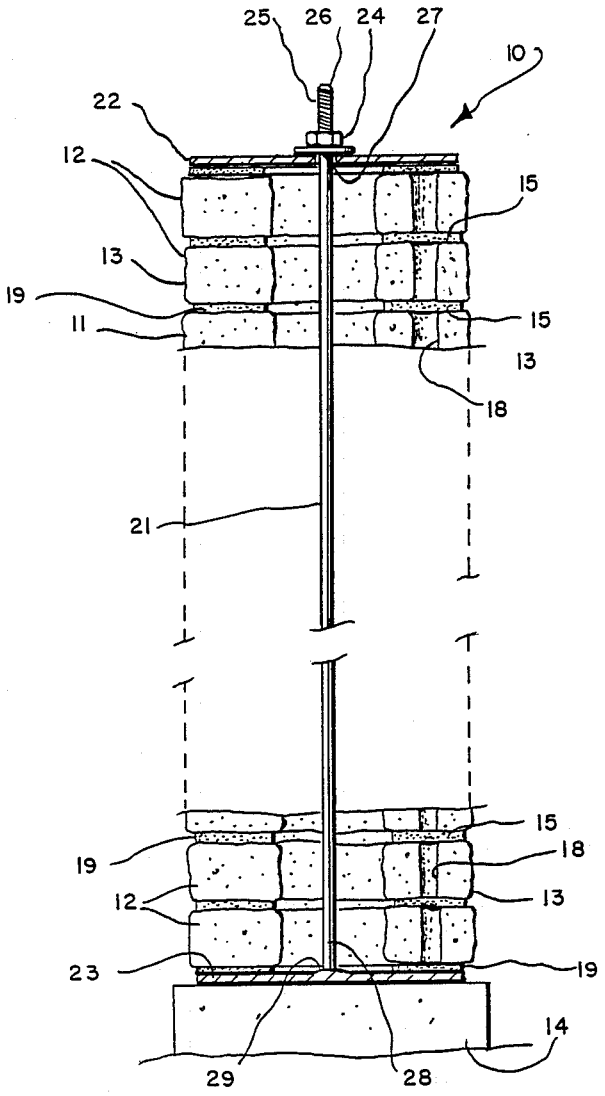

The mortar-free masonry structure system 10 may be embodied in diverse forms as required by the particular edifice or structure to which it is applied. In FIGS. 1 and 2, system 10 is shown used for a decorative driveway entrance post 11 utilizing conventional fired clay bricks 12. Post 11 comprises stacked masonry layers 13 each including four of the bricks 12 placed successively end to side in a square pattern. Conventional concrete foundation 14 may be utilized, along with a decorative top cover structure, not shown. The bricks 12 each have flat upper and lower horizontal sides 15, and two pairs 16 and 17 of flat vertical sides, longer and shorter, respectively. Vertical holes 18 are often provided to assist in the curing of the bricks, and also to act as invisible excess mortar cavities during conventional construction.

Where mortar would be found in conventional construction, an interface member 19 of compressible, preferably elastic, material is provided between each horizontal layer 13 of bricks 12, for appearance and weather sealing, vertical interface members 20 may also be provided between facing sides 16 and 17.

The stacked horizontal layers 13 are secured together by a tension rod 21 acting through upper and lower anchor plates 22 and 23, respectively, each sized and shaped to bear upon the adjacent end of post 11. Nut 24 engages threads 25 on top end 26 of rod 21 protruding through bore 27 in upper plate 22. Lower end 28 is attached, as by welds 29, to lower anchor plate 23. Tightening of nut 24 provides compressive force to stacked layers 13 through plates 22 and 23, compressing the interface layers 19 and binding post 11 into a stable integrated structure. Each brick 12 is gripped firmly above and below by interface members 19, each of which is compressed to conform to the erose surfaces of the contacting brick. The binding friction is enhanced also by extrusion of interface members into the holes 18.

Compression anchor plates 22 and 23 may be of any suitable high strength, rigid material Flat steel plates may be advantageously employed. Formed plates, ribbed for rigidity and material conservation, may be desireable. Among other examples is wood, possibly in multilayered, cross-grained form. The interface members 19 and 20 may be of any available compressible material. Various plastics, with or without fiber reinforcement, could be employed. Pressed wood, and even sawed planking, are viable alternatives. A degree of give, whether elastic or plastic, is highly desirable, so that the members may be pressed to conform to irregularities in the masonry unit surfaces.

Figure 3:
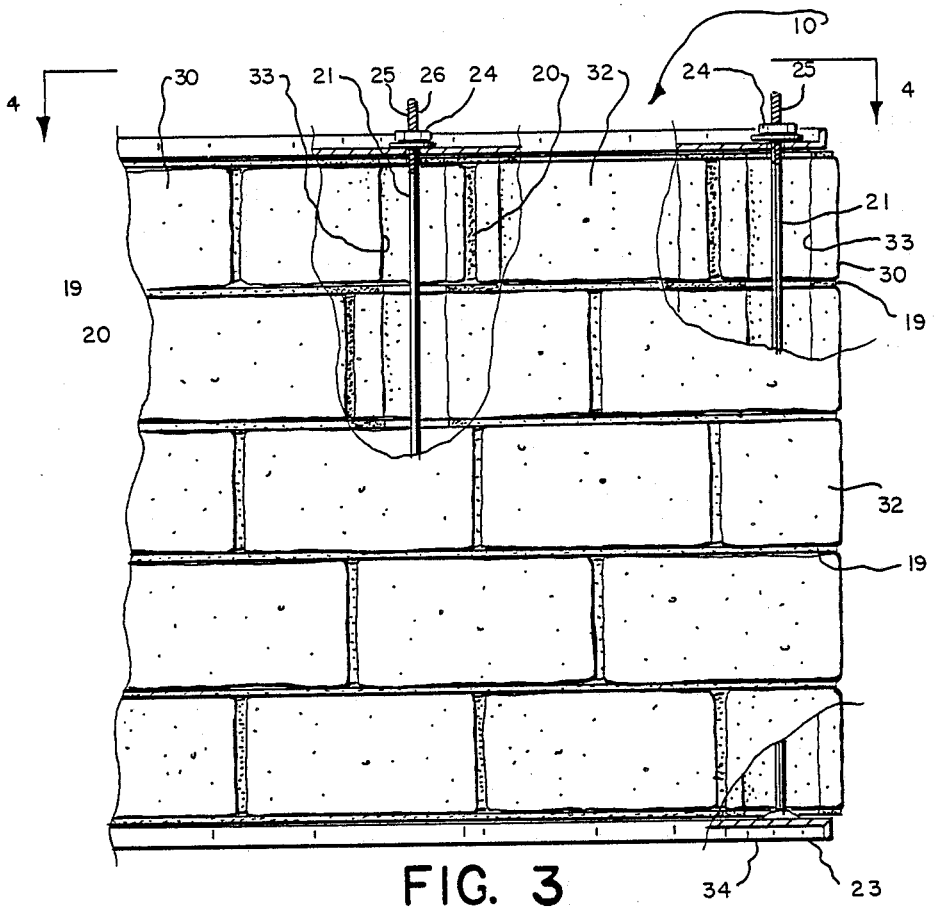
Figure 4:
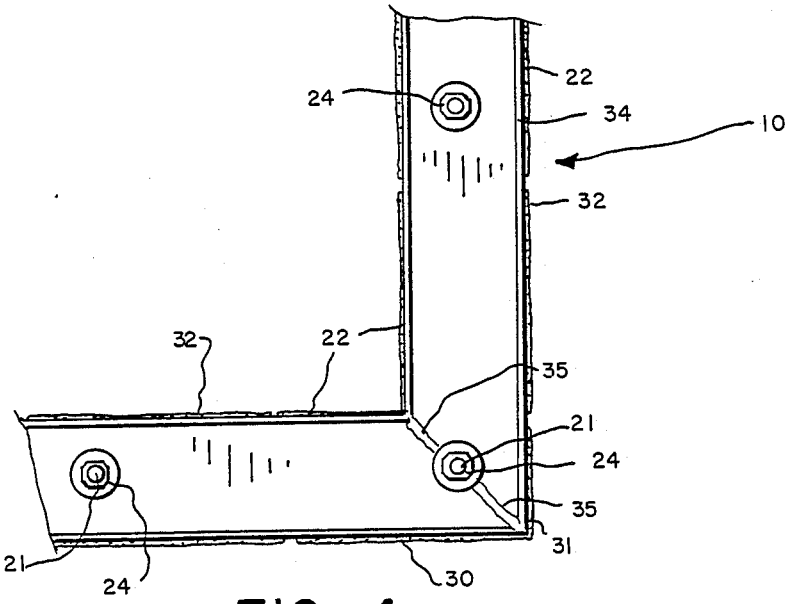

In FIGS. 3 and 4, system 10 is illustrated applied to wall and corner masonry constructions 30 and 31, respectively, using concrete blocks 32 as the building units. Cast vertical holes 33 are utilized for installation of tension rods 21. If bricks 12 had been used, the corresponding mortar holes 18 would have been utilized in the same manner. Top and bottom rod anchor members 22 and 23 are preferably continuously integral the full lengths of the walls 30. Standard steel channels 34 may be utilized for anchor members 22 and 23. The channels 34 may be secured together as by welds 35, at the corner 31, providing continuity and strength.

Mortar-free masonry system 10 is most readily adapted for use in posts, walls, and other vertical structures behaving essentially as columns. In these instances, the tension rods 21 are installed vertically. However, the system 10 may also be used in structures wherein the tension rods are horizontal. For example, brick stairsteps, not illustrated, could if desired be made up of bricks 12 disposed to be tied together by tension rods 21 installed horizontally. Such a structure may, because of yielding of the interface layers 19 under compressive stress, require both end and intermediate support to prevent sagging.

The invention may be embodied in other specific forms without departing from the spirit or essential characteristics thereof. The present embodiments are therefore to be considered as illustrative and not restrictive, the scope of the invention being indicated by the appended claims rather than by the foregoing description, and all changes that come within the meaning and range of equivalency of the claims are therefore intended to be embraced therein.

What is claimed and desired to be secured by United States Letters Patent is:

1. A masonry building system using conventional flat sided building units, said system comprising:

at least one series of at least two of said units arranged with facing pairs of flat sides;

a flat compressible non-metallic, non-masonry interface plate member placed between each of the pairs of facing sides of the units of the series unbonded thereto; and a pair of plates, one bearing upon the outermost flat side of one end unit and the other upon the outermost flat side of the remaining end unit of the series; and at least one tension member placed to act between the pair of plates to urge the units into forcible contact of their facing flat sides with the flat compressible interface plate member therebetween.

2. The building system of claim 1, wherein:

the system comprises at least two of the series of units, said two units being adjacently disposed;

each of the interface members of the adjacent series is integral and continuous therebetween;

each one of the pair of plates for the adjacent series is integral and continuous therebetween.

3. The building system of claim 2, wherein:

at least a portion of the units of each series overlaps corresponding units of each series adjacent thereto.

4. The building system of claim 2, wherein:

the conventional building units incorporate one or more holes therethrough joining the facing flat sides;

the units in each series are placed with aligned holes as necessary to provide at least one continuous passage through the series; and the tension member is installed within the continuous passage.

5. The building system of claim 4, wherein the tension member comprises:

an elongate metallic member, at least one end portion of which carries threads; and a rotatable member adapted to engage the threads so that rotation thereof induces tension in the elongate metallic member.

6. The building system of claim 2, wherein the tension member comprises:

an elongate metallic member, at least one end portion of which carries threads; and a rotatable member adapted to engage the threads so that rotation thereof induces tension in the elongate metallic member.

7. The building system of claim 1, wherein the tension member comprises:

an elongate metallic member, at least one end portion of which carries threads; and a rotatable member adapted to engage the threads so that rotation thereof induces tension in the elongate metallic member.

* * * * *